US005735719A

United States Patent [19]

Berg

[11] Patent Number: 5,735,719

[45] Date of Patent: Apr. 7, 1998

[54] COMBINATION INFLATABLE DIVE FLAG AND FLOAT

[76] Inventor: Daniel T. Berg, 2745 Cheshire Dr., Baldwin, N.Y. 11510

[21] Appl. No.: 759,162

[22] Filed: Dec. 3, 1996

[51] Int. Cl.[6] ..... B63B 22/20; B63B 22/22

[52] U.S. Cl. ..... 441/11; 441/21; 441/28; 441/30

[58] Field of Search ..... 441/6, 11, 20, 441/21, 23, 30, 90, 92, 28; 116/173, 210; 405/186; 440/96

[56] References Cited

U.S. PATENT DOCUMENTS

| | | | |
|---|---|---|---|
| 3,149,352 | 9/1964 | Christiansen | 441/111 |
| 3,760,440 | 9/1973 | Casciano | 9/8 R |
| 3,866,253 | 2/1975 | Sinks et al. | 405/186 |
| 4,092,756 | 6/1978 | Stier | 9/8 R |
| 4,144,606 | 3/1979 | McIntyre | 9/8 R |
| 4,475,476 | 10/1984 | Howard | 116/210 |
| 4,762,145 | 8/1988 | Stradella | 441/96 |
| 5,141,458 | 8/1992 | Church | 441/26 |
| 5,295,765 | 3/1994 | Choi | 405/186 |

*Primary Examiner*—Sherman Basinger
*Attorney, Agent, or Firm*—Richard L. Miller, P. E.

[57] ABSTRACT

A combination inflatable dive flag and float that visually marks a position in a waterway where a diver is diving. The combination includes an inflatable, hollow, elongated, slender, vertically-oriented, and generally cylindrically-shaped mast tube, and a rectangular-shaped flag. The inflatable, hollow, elongated, slender, vertically-oriented, and generally cylindrically-shaped mast tube is upright extendable from the position in the waterway where the diver is diving and has an upper portion that terminates in a flat, closed, and horizontally-oriented upper end that extends out of the waterway, a lower portion that terminates in a flat, closed, and generally rectangular-shaped lower end that extends into the waterway, a generally cylindrically-shaped outer surface, and a deflated position, so that the combination inflatable dive flag and float can be deflated and rolled for transit and storage.

22 Claims, 1 Drawing Sheet

FIG. 1
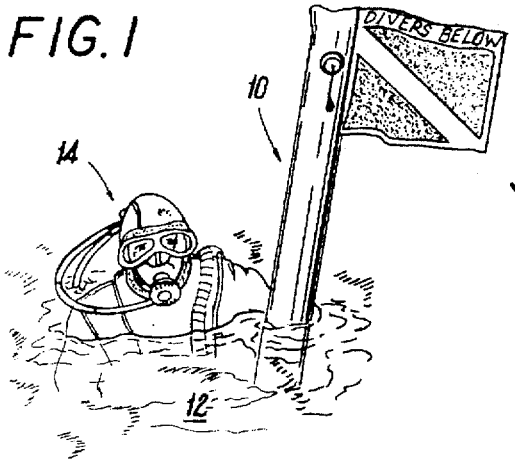
FIG. 4
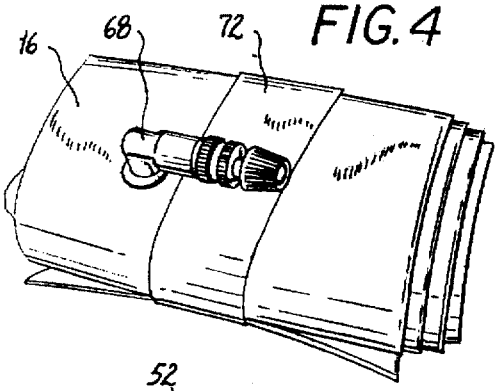
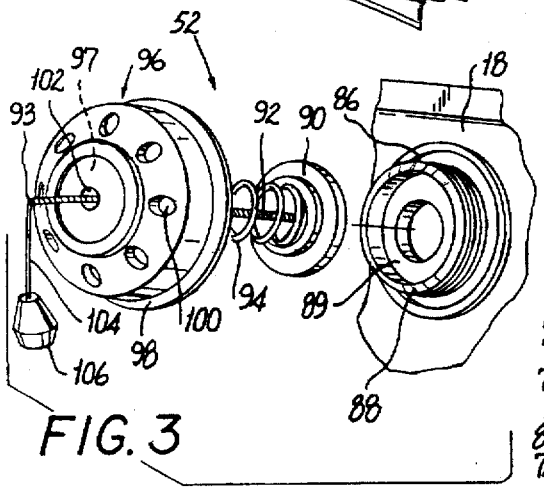
FIG. 3
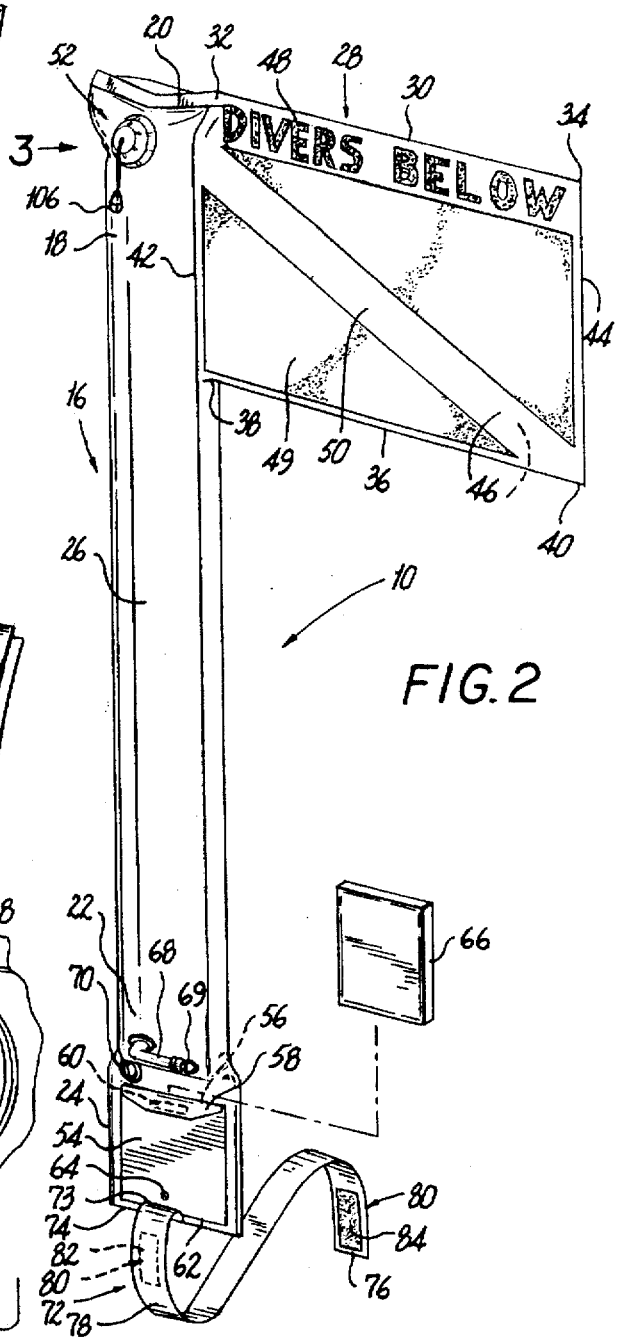
FIG. 2

COMBINATION INFLATABLE DIVE FLAG AND FLOAT

BACKGROUND OF THE INVENTION

The present invention relates to a dive marker. More particularly, the present invention relates to a combination inflatable dive flag and float that visually marks a position in a waterway where a diver is diving wherein the combination includes an inflatable, hollow, elongated, slender, vertically-oriented, and generally cylindrically-shaped mast tube that is upright extendable from the position in the waterway where the diver is diving and has an upper portion that terminates in a flat, closed, and horizontally-oriented upper end that extends out of the waterway, a lower portion that terminates in a flat, closed, and generally rectangular-shaped lower end that extends into the waterway, a generally cylindrically-shaped outer surface, and a deflated position, so that the combination inflatable dive flag and float can be deflated and rolled for transit and storage, and an rectangular-shaped flag that extends perpendicularly horizontally outwardly from, and is integral with, the upper portion of the inflatable, hollow, elongated, slender, vertically-oriented, and generally cylindrically-shaped mast tube, with the vertically-oriented inner edge of the rectangular-shaped flag being disposed longitudinally along the generally cylindrically-shaped outer surface of the inflatable, hollow, elongated, slender, vertically-oriented, and generally cylindrically-shaped mast tube, and with the horizontally-oriented upper edge of the rectangular-shaped flag being collinear with the flat, closed, and horizontally-oriented upper end of the inflatable, hollow, elongated, slender, vertically-oriented, and generally cylindrically-shaped mast tube, so that the position in the waterway where the diver is diving is visually marked.

In recreational diving in this country, a flag known as the "diver's down" flag is flown either from an anchored bloat, from which divers may be diving, and/or from a surface float which is towed by the diver by means of a line attached to the float. Alternatively, the line from the float may be attached to the bottom. The "diver's down" flag is a rectangular or square field of red having a white stripe extending diagonally downward from the top of the mast to the lower, outer corner of the flag.

Conventionally, "diver's down" flags for sport diving are sold together with an elongate mast having a styrofoam float about the mid-portion of the mast and a small lead weight at the lower, submerged end of the mast. Such devices have at least two major disadvantages. First, the mast is so long or tall that the device cannot be easily stored with the diver's other gear as he travels to and from the diving site. For example, many sport divers pack their diving gear in a bag similar to a duffel bag. The diver's flag mast is far too long to fit within such a gag. A second objection to this type of diver's flag is that the float is made of fragile material (i.e. styrofoam) that soon becomes crushed or broken during transport.

Numerous innovations for dive markers have been provided in the prior art that will be described. Even though these innovations may be suitable for the specific individual purposes to which they address, however, they differ from the present invention in that they do not teach a combination inflatable dive flag and float that visually marks a position in a waterway where a diver is diving wherein the combination includes an inflatable, hollow, elongated, slender, vertically-oriented, and generally cylindrically-shaped mast tube that is upright extendable from the position in the waterway where the diver is diving and has an upper portion that terminates in a flat, closed, and horizontally-oriented upper end that extends out of the waterway, a lower portion that terminates in a flat, closed, and generally rectangular-shaped lower end that extends into the waterway, a generally cylindrically-shaped outer surface, and a deflated position, so that the combination inflatable dive flag and float can be deflated and rolled for transit and storage, and an rectangular-shaped flag that extends perpendicularly horizontally outwardly from, and is integral with, the upper portion of the inflatable, hollow, elongated, slender, vertically-oriented, and generally cylindrically-shaped mast tube, with the vertically-oriented inner edge of the rectangular-shaped flag being disposed longitudinally along the generally cylindrically-shaped outer surface of the inflatable, hollow, elongated, slender, vertically-oriented, and generally cylindrically-shaped mast tube, and with the horizontally-oriented upper edge of the rectangular-shaped flag being collinear with the flat, closed, and horizontally-oriented upper end of the inflatable, hollow, elongated, slender, vertically-oriented, and generally cylindrically-shaped mast tube, so that the position in the waterway where the diver is diving is visually marked.

FOR EXAMPLE, U.S. Pat. No. 3,760,440 to Casciano teaches a device for divers and especially divers in ocean work and exploration. The diver wears a container having means to accommodate one or more capsules in which is stored a flexible bag which is to be inflated. When the bag is inflated, it rises to the surface of the water and becomes a signal or a marker buoy.

ANOTHER EXAMPLE, U.S. Pat. No. 4,092,756 to Stier teaches a diver's caddy vessel adapted primarily to move beneath a seaway surface. The vessel is made buoyant by the diver's exhalant into a skirt of the vessel to offset suspension weight of diver's gear, game and the like. The vessel is characterized by a collapsible, bladder-like enclosure which is elongate in exterior configuration and open at the bottom. The bottom is defined by a dependent skirt and having a stringer interiorally thereof. The caddy stringer is adapted to the detachable engagement of a restraint line to the diver and/or stringer extensions for gear and game. The vessel further includes a connector at one end for towing on a seaway surface.

STILL ANOTHER EXAMPLE, U.S. Pat. No. 4,144,606 to McIntyre teaches a collapsible spar buoy made of separable sections having a flag and requiring no conventional, additional float device. A central section and a base member entrap air to serve as a float. This central section houses all the other components when the buoy and flag are stored. The flag may be conventionally mounted or centrally mounted so that its mass is centered with respect to the mass of the buoy and thus the buoy and flag assume a vertical attitude in the water.

FINALLY, YET ANOTHER EXAMPLE, U.S. Pat. No. 5,141,458 to Church teaches a marker buoy, typically for use by divers. The buoy includes a lighter-than-water flotation component, such as a bladder which can be inflated when the buoy is required to float and deflated when it is not required to float, so that the diver can easily dive with the deflated buoy and inflate it at depths, when required. A reel of line carried by the buoy is arranged to dispense the line therefrom when the tension in the line exceeds a chosen value.

It is apparent that numerous innovations for dive markers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a combination inflatable dive flag and float that avoids the disadvantages of the prior art.

ANOTHER OBJECT of the present invention is to provide a combination inflatable dive flag and float that is simple and inexpensive to manufacture.

STILL ANOTHER OBJECT of the present invention is to provide a combination inflatable dive flag and float that is simple to use.

YET ANOTHER OBJECT of the present invention is to provide a combination inflatable dive flag and float that is a compact and easily deployed flag and float combination.

STILL YET ANOTHER OBJECT of the present invention is to provide a combination inflatable dive flag and float that eliminates the need for bulky old fashioned fiberglass poles and foam floats.

YET STILL ANOTHER OBJECT of the present invention is to provide a combination inflatable dive flag and float that eliminates the need for old fashioned flag floats that are easily broken and extremely inconvenient to store and transport.

STILL YET ANOTHER OBJECT of the present invention is to provide a combination inflatable dive flag and float that meets all state and Coast Guard regulations.

YET STILL ANOTHER OBJECT of the present invention is to provide a combination inflatable dive flag and float that can be easily carried and stored in the diver's gear bag.

STILL YET ANOTHER OBJECT of the present invention is to provide a combination inflatable dive flag and float that can be rolled and carried throughout the dive.

YET STILL ANOTHER OBJECT of the present invention is to provide a combination inflatable dive flag and float that can be inflated for maximum shaft rigidity by an air gun attached to any scuba regulator low pressure hose.

STILL YET ANOTHER OBJECT of the present invention is to provide a combination inflatable dive flag and float that can be orally inflated when used as a maximum visibility safety tube.

YET STILL ANOTHER OBJECT of the present invention is to provide a combination inflatable dive flag and float that can belongs in every diver's gear bag.

STILL YET ANOTHER OBJECT of the present invention is to provide a combination inflatable dive flag and float that visually marks a position in a waterway where a diver is diving.

BRIEFLY STATED, YET STILL ANOTHER OBJECT of the present invention is to provide a combination inflatable dive flag and float that includes an inflatable, hollow, elongated, slender, vertically-oriented, and generally cylindrically-shaped mast tube, and a rectangular-shaped flag.

STILL YET ANOTHER OBJECT of the present invention is to provide a combination inflatable dive flag and float wherein the inflatable, hollow, elongated, slender, vertically-oriented, and generally cylindrically-shaped mast tube is upright extendable from the position in the waterway where the diver is diving and has an upper portion that terminates in a flat, closed, and horizontally-oriented upper end that extends out of the waterway, a lower portion that terminates in a flat, closed, and generally rectangular-shaped lower end that extends into the waterway, a generally cylindrically-shaped outer surface, and a deflated position, so that the combination inflatable dive flag and float can be deflated and rolled for transit and storage.

YET STILL ANOTHER OBJECT of the present invention is to provide a combination inflatable dive flag and float wherein the rectangular-shaped flag has a horizontally-oriented upper edge with a proximal end and a distal end, a horizontally-oriented lower edge disposed below, and parallel to, the horizontally-oriented upper edge of the rectangular-shaped flag and has a proximal end and a distal end, a vertically-oriented inner edge that extends perpendicularly downwardly from the proximal end of the horizontally-oriented upper edge of the rectangular-shaped flag to the proximal end of the horizontally-oriented lower edge of the rectangular-shaped flag, a vertically-oriented outer edge that extends perpendicularly downwardly from the distal end of the horizontally-oriented upper edge of the rectangular-shaped flag to the distal end of the horizontally-oriented lower edge of the rectangular-shaped flag, and a pair of flat, parallel, opposing, and rectangular-shaped outer faces.

STILL YET ANOTHER OBJECT of the present invention is to provide a combination inflatable dive flag and float wherein the rectangular-shaped flag extends perpendicularly horizontally outwardly from, and is integral with, the upper portion of the inflatable, hollow, elongated, slender, vertically-oriented, and generally cylindrically-shaped mast tube, with the vertically-oriented inner edge of the rectangular-shaped flag being disposed longitudinally along the generally cylindrically-shaped outer surface of the inflatable, hollow, elongated, slender, vertically-oriented, and generally cylindrically-shaped mast tube, and with the horizontally-oriented upper edge of the rectangular-shaped flag being collinear with the flat, closed, and horizontally-oriented upper end of the inflatable, hollow, elongated, slender, vertically-oriented, and generally cylindrically-shaped mast tube, so that the position in the waterway where the diver is diving is visually marked.

YET STILL ANOTHER OBJECT of the present invention is to provide a combination inflatable dive flag and float wherein the inflatable, hollow, elongated, slender, vertically-oriented, and generally cylindrically-shaped mast tube is 6" in diameter, 4' high, and is of one of nylon BC and lift bag material.

STILL YET ANOTHER OBJECT of the present invention is to provide a combination inflatable dive flag and float wherein the rectangular-shaped flag is one of a standard size dive flag and an Alpha flag.

YET STILL ANOTHER OBJECT of the present invention is to provide a combination inflatable dive flag and float wherein each face of the pair of flat, parallel, opposing, and rectangular-shaped outer faces of the rectangular-shaped flag includes a red "DIVERS BELOW" indica that extends therealong between the vertically-oriented inner edge of the rectangular-shaped flag and the vertically-oriented outer edge of the rectangular-shaped flag, and is parallel to, and slightly below, the horizontally-oriented upper edge of the rectangular-shaped flag.

STILL YET ANOTHER OBJECT of the present invention is to provide a combination inflatable dive flag and float wherein each face of the pair of flat, parallel, opposing, and rectangular-shaped outer faces of the rectangular-shaped flag further includes a red and rectangular-shaped field that extends from the vertically-oriented inner edge of the rectangular-shaped flag to the vertically-oriented outer edge of the rectangular-shaped flag, and from the horizontally-oriented lower edge of the rectangular-shaped flag to slightly below the red "DIVERS BELOW" indica on the rectangular-shaped flag.

YET STILL ANOTHER OBJECT of the present invention is to provide a combination inflatable dive flag and float wherein the red and rectangular-shaped field of each face of the pair of flat, parallel, opposing, and rectangular-shaped outer faces of the rectangular-shaped flag includes a diagonally-oriented white stripe that extends diagonally downwardly thereacross.

STILL YET ANOTHER OBJECT of the present invention is to provide a combination inflatable dive flag and float that further includes an automatic pressure relief and manual deflation valve that is in fluid communication with the inflatable, hollow, elongated, slender, vertically-oriented, and generally cylindrically-shaped mast tube and provides an automatic means of preventing over inflation and potential rupture of the inflatable, hollow, elongated, slender, vertically-oriented, and generally cylindrically-shaped mast tube while also providing a manual means of deflating the inflatable, hollow, elongated, slender, vertically-oriented, and generally cylindrically-shaped mast tube when desired.

YET STILL ANOTHER OBJECT of the present invention is to provide a combination inflatable dive flag and float wherein the automatic pressure relief and manual deflation valve is disposed on the upper portion of the inflatable, hollow, elongated, slender, vertically-oriented, and generally cylindrically-shaped mast tube, in proximity of the flat, closed, and horizontally-oriented upper end of the inflatable, hollow, elongated, slender, vertically-oriented, and generally cylindrically-shaped mast tube.

STILL YET ANOTHER OBJECT of the present invention is to provide a combination inflatable dive flag and float wherein the automatic pressure relief and manual deflation valve includes a ring-shaped flange that is in fluid communication with the inflatable, hollow, elongated, slender, vertically-oriented, and generally cylindrically-shaped mast tube and is fixedly attached to the upper portion of the inflatable, hollow, elongated, slender, vertically-oriented, and generally cylindrically-shaped mast tube, in proximity of the flat, closed, and horizontally-oriented upper end of the inflatable, hollow, elongated, slender, vertically-oriented, and generally cylindrically-shaped mast tube.

YET STILL ANOTHER OBJECT of the present invention is to provide a combination inflatable dive flag and float wherein the automatic pressure relief and manual deflation valve further includes a hollow, externally-threaded, and cylindrically-shaped neck that extends perpendicularly outwardly from, and is in fluid communication with, the ring-shaped flange of the automatic pressure relief and manual deflation valve, and contains a valve seat.

STILL YET ANOTHER OBJECT of the present invention is to provide a combination inflatable dive flag and float wherein the automatic pressure relief and manual deflation valve further includes a circular-shaped diaphragm disposed in, and selectively opening and closing, the hollow, externally-threaded, and cylindrically-shaped neck of the automatic pressure relief and manual deflation valve by selective contact against the valve seat in the hollow, externally-threaded, and cylindrically-shaped neck of the automatic pressure relief and manual deflation valve.

YET STILL ANOTHER OBJECT of the present invention is to provide a combination inflatable dive flag and float wherein the automatic pressure relief and manual deflation valve further includes a slender rod that extends perpendicularly outwardly from the circular-shaped diaphragm of the automatic pressure relief and manual deflation valve, and terminates in a free end.

STILL YET ANOTHER OBJECT of the present invention is to provide a combination inflatable dive flag and float wherein the automatic pressure relief and manual deflation valve further includes a spring that has a compression factor and encircles the slender rod of the automatic pressure relief and manual deflation valve with one end of the spring of the automatic pressure relief and manual deflation valve abutting against the circular-shaped diaphragm of the automatic pressure relief and manual deflation valve.

YET STILL ANOTHER OBJECT of the present invention is to provide a combination inflatable dive flag and float wherein the automatic pressure relief and manual deflation valve further includes an internally threaded cap that threadably engages the hollow, externally-threaded, and cylindrically-shaped neck of the automatic pressure relief and manual deflation valve and has an inner surface and a cap ring-shaped flange that sealingly abuts against the ring-shaped flange of the automatic pressure relief and manual deflation valve.

STILL YET ANOTHER OBJECT of the present invention is to provide a combination inflatable dive flag and float wherein the internally threaded cap of the automatic pressure relief and manual deflation valve further has a plurality of circumferential throughbores disposed therearound and a centrally-disposed throughbore that freely receives the slender rod of the automatic pressure relief and manual deflation valve with the free end of the slender rod of the automatic pressure relief and manual deflation valve extending therethrough and with another end of the spring of the automatic pressure relief and manual deflation valve abutting against the inner surface of the internally threaded cap of the automatic pressure relief and manual deflation valve so as to bias the circular-shaped diaphragm of the automatic pressure relief and manual deflation valve against the valve seat in the hollow, externally-threaded, and cylindrically-shaped neck of the automatic pressure relief and manual deflation valve and maintain air with a pressure in the inflatable, hollow, elongated, slender, vertically-oriented, and generally cylindrically-shaped mast tube until the inflatable, hollow, elongated, slender, vertically-oriented, and generally cylindrically-shaped mast tube becomes overinflated wherein the pressure of the air is greater than the compression factor of the spring of the automatic pressure relief and manual deflation valve and the pressure of the air causes the circular-shaped diaphragm of the automatic pressure relief and manual deflation valve to displace away from the valve seat in the hollow, externally-threaded, and cylindrically-shaped neck of the automatic pressure relief and manual deflation valve, against biasing of the spring of the automatic pressure relief and manual deflation valve, and allow the air to escape through the plurality of circumferential throughbores in the internally threaded cap of the automatic pressure relief and manual deflation valve until the pressure of the air is less than the compression factor of the spring of the automatic pressure relief and manual deflation valve causing the spring of the automatic pressure relief and manual deflation valve to expand and reseat the circular-shaped diaphragm of the automatic pressure relief and manual deflation valve against the valve seat in the hollow, externally-threaded, and cylindrically-shaped neck of the automatic pressure relief and manual deflation valve.

YET STILL ANOTHER OBJECT of the present invention is to provide a combination inflatable dive flag and float wherein the automatic pressure relief and manual deflation valve further includes a pull string that extends from the free end of the slender rod of the automatic pressure relief and manual deflation valve and terminates in an appropriately-shaped hand gripper that fits comfortably in a hand of the diver and provides a means, when pulled, for causing the slender rod of the automatic pressure relief and manual deflation valve to extend further out of the centrally-disposed throughbore in the internally threaded cap of the automatic pressure relief and manual deflation valve and displace the circular-shaped diaphragm of the automatic pressure relief and manual deflation valve away from the valve seat in the hollow, externally-threaded, and cylindrically-shaped neck of the automatic pressure relief and manual deflation valve, against the biasing of the spring of the automatic pressure relief and manual deflation valve, and allow the air to escape through the plurality of circumferential throughbores in the internally threaded cap of the automatic pressure relief and manual deflation valve and deflate the inflatable, hollow, elongated, slender, vertically-oriented, and generally cylindrically-shaped mast tube when desired.

STILL YET ANOTHER OBJECT of the present invention is to provide a combination inflatable dive flag and float that further includes a rectangular-shaped weight pocket that is disposed on, and covers, one side of the flat, closed, and generally rectangular-shaped lower end of the lower portion of the inflatable, hollow, elongated, slender, vertically-oriented, and generally cylindrically-shaped mast tube and has an open top with a flap that is selectively opened and closed by hook and loop fasteners, and a closed bottom.

YET STILL ANOTHER OBJECT of the present invention is to provide a combination inflatable dive flag and float wherein the rectangular-shaped weight pocket further has a drain hole in proximity of the closed bottom of the rectangular-shaped weight pocket which provides a drain for any water trapped in the rectangular-shaped weight pocket.

STILL YET ANOTHER OBJECT of the present invention is to provide a combination inflatable dive flag and float that further includes at least one rectangular-shaped weight that is replaceably insertable in the rectangular-shaped weight pocket and provides ballast for maintaining the inflatable, hollow, elongated, slender, vertically-oriented, and generally cylindrically-shaped mast tube upright in the waterway.

YET STILL ANOTHER OBJECT of the present invention is to provide a combination inflatable dive flag and float wherein the at least one rectangular-shaped weight is a standard 5–6 lb. lead diver's weight.

STILL YET ANOTHER OBJECT of the present invention is to provide a combination inflatable dive flag and float that further includes a L-shaped inflation valve that is in fluid communication with, and provides a means of inflating, the inflatable, hollow, elongated, slender, vertically-oriented, and generally cylindrically-shaped mast tube.

YET STILL ANOTHER OBJECT of the present invention is to provide a combination inflatable dive flag and float wherein the L-shaped inflation valve is disposed on the lower portion of the inflatable, hollow, elongated, slender, vertically-oriented, and generally cylindrically-shaped mast tube, in proximity of the flat, closed, and generally rectangular-shaped lower end of the lower portion of the inflatable, hollow, elongated, slender, vertically-oriented, and generally cylindrically-shaped mast tube.

STILL YET ANOTHER OBJECT of the present invention is to provide a combination inflatable dive flag and float wherein the L-shaped inflation valve is one of releasibly connectable to an air gun that is attachable to a scuba regulator low pressure hose and orally accessible, and has an orifice that is selectively opened and closed by a cap.

YET STILL ANOTHER OBJECT of the present invention is to provide a combination inflatable dive flag and float that further includes a grommet eye for releasibly attaching the combination inflatable dive flag and float to one of an anchor line and a tow line and being disposed through the flat, closed, and generally rectangular-shaped lower end of the lower portion of the inflatable, hollow, elongated, slender, vertically-oriented, and generally cylindrically-shaped mast tube, between the L-shaped inflation valve and the flap of the rectangular-shaped weight pocket.

FINALLY, STILL YET ANOTHER OBJECT of the present invention is to provide a combination inflatable dive flag and float that further includes an elongated, slender, and rectangular-shaped strap that has a proximal end fixedly attached to, and extending downwardly from, a lowermost horizontally-oriented edge of the flat, closed, and generally rectangular-shaped lower end of the lower portion of the inflatable, hollow, elongated, slender, vertically-oriented, and generally cylindrically-shaped mast tube, a free distal end, a pair of parallel, and opposing faces, and hook and loop fasteners with a hook portion affixed on one face of the pair of parallel, and opposing faces of the elongated, slender, and rectangular-shaped strap in proximity of the proximal end of the elongated, slender, and rectangular-shaped strap and a mating loop portion affixed on another face of the pair of parallel, and opposing faces of the elongated, slender, and rectangular-shaped strap in proximity to the free distal end of the elongated, slender, and rectangular-shaped strap and releasibly engagable with the hook portion of the strap hook and loop fasteners on the elongated, slender, and rectangular-shaped strap.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view illustrating the present invention utilized to mark the position of a dive;

FIG. 2 is an enlarged perspective view of the present invention in an inflated position;

FIG. 3 is an enlarged diagrammatic perspective view of the automatic pressure relief and manual deflation valve generally enclosed in the dotted circle identified by arrow 3 in FIG. 2; and FIG. 4 is a diagrammatic perspective view of the present invention in a deflated position and rolled for transport or storage.

LIST OF REFERENCE NUMERALS UTILIZED IN THE DRAWING

| | |
|---|---|
| 10 | combination inflatable dive flag and float of the present invention |
| 12 | water way |
| 14 | diver |

-continued

| LIST OF REFERENCE NUMERALS UTILIZED IN THE DRAWING | |
|---|---|
| 16 | inflatable, hollow, elongated, slender, vertically-oriented, and generally cylindrically-shaped mast tube |
| 18 | mast tube upper portion |
| 20 | mast tube upper portion flat, closed, and horizontally-oriented upper end |
| 22 | mast tube lower portion |
| 24 | mast tube lower portion flat, closed, and generally rectangular-shaped lower end |
| 26 | mast type generally cylindrically-shaped outer surface |
| 28 | rectangular-shaped flag |
| 30 | flag horizontally-oriented upper edge |
| 32 | flag upper edge proximal end |
| 34 | flag upper edge distal end |
| 36 | flag horizontally-oriented lower edge |
| 38 | flag lower edge proximal end |
| 40 | flag lower edge distal end |
| 42 | flag vertically-oriented inner edge |
| 44 | flag vertically-oriented outer edge |
| 46 | pair of flat, parallel, opposing, and rectangular-shaped outer faces |
| 48 | flag face red "DIVERS BELOW" indica |
| 49 | flag face red and rectangular-shaped field |
| 50 | flag face field diagonally-oriented white stripe |
| 52 | automatic pressure relief and manual deflation valve |
| 54 | rectangular-shaped weight pocket |
| 56 | pocket open top |
| 58 | pocket top flap |
| 60 | pocket top flap hook and loop fasteners |
| 62 | pocket closed bottom |
| 64 | pocket drain throughbore |
| 66 | at least one rectangular-shaped weight |
| 68 | L-shaped inflation valve |
| 69 | inflation valve cap |
| 70 | anchor line grommet eye |
| 72 | elongated, slender, and rectangular-shaped strap |
| 73 | strap proximal end |
| 74 | mast tube lower portion lower end lowermost horizontally-oriented edge |
| 76 | strap free distal end |
| 78 | pair of parallel, and opposing faces |
| 80 | strap hook and loop fasteners |
| 82 | strap hook and loop fasteners hook portion |
| 84 | strap hook and loop fasteners mating loop portion |
| 86 | valve ring-shaped flange |
| 88 | valve hollow, externally-threaded, and cylindrically-shaped neck |
| 89 | valve neck seat |
| 90 | valve circular-shaped diaphragm |
| 92 | valve slender rod |
| 93 | valve rod free end |
| 94 | valve spring |
| 96 | valve internally threaded cap |
| 97 | valve cap inner surface |
| 98 | valve cap ring-shaped flange |
| 100 | valve cap plurality of circumferential throughbores |
| 102 | valve cap centrally-disposed throughbore |
| 104 | valve pull string |
| 106 | appropriately-shaped hand gripper |

DETAILED DESCRIPTION OF THE PREFERRED EMBODIMENT

Referring now to the figures in which like numerals indicate like parts, and particularly to FIG. 1, which is a diagrammatic perspective view illustrating the present invention utilized to mark the position of a dive, the combination inflatable dive flag and float of the present invention is shown generally at 10 in an inflated position and remaining vertically upright in a water way 12 and marking a position for a dive by a diver 14.

The configuration of the combination inflatable dive flag and float 10 in the inflated position can-best be seen in FIG. 2, which is an enlarged perspective view of the present invention in an inflated position, and as such will be discussed with reference thereto.

The combination inflatable dive flag and float 10 includes an inflatable, hollow, elongated, slender, vertically-oriented, and generally cylindrically-shaped mast tube 16 that is preferably 6" in diameter, 4' high, of nylon or lift bag material, and has a deflated position where it can be rolled for transport and storage.

The inflatable, hollow, elongated, slender, vertically-oriented, and generally cylindrically-shaped mast tube 16 further has a mast tube upper portion 18 that terminates in a mast tube upper portion flat, closed, and horizontally-oriented upper end 20, a mast tube lower portion 22 that terminates in a mast tube lower portion flat, closed, and generally rectangular-shaped lower end 24, and a mast tube generally cylindrically-shaped outer surface 26.

The combination inflatable dive flag and float 10 further includes a rectangular-shaped flag 28 that is of a standard size dive flag or an Alpha flag and has a flag horizontally-oriented upper edge 30 with a flag upper edge proximal end 32 and a flag upper edge distal end 34, a flag horizontally-oriented lower edge 36 that is disposed below, and parallel to, the flag horizontally-oriented upper edge 30 of the rectangular-shaped flag 28 and has a flag lower edge proximal end 38 and a flag lower edge distal end 40, a flag vertically-oriented inner edge 42 that extends perpendicularly downwardly from the flag upper edge proximal end 32 of the flag horizontally-oriented upper edge 30 of the rectangular-shaped flag 28 to the flag lower edge proximal end 38 of the flag horizontally-oriented lower edge 36 of the rectangular-shaped flag 28, a flag vertically-oriented outer edge 44 that extends perpendicularly downwardly from the flag upper edge distal end 34 of the flag horizontally-oriented upper edge 30 of the rectangular-shaped flag 28 to the flag lower edge distal end 40 of the flag horizontally-oriented lower edge 36 of the rectangular-shaped flag 28, and a pair of flat, parallel, opposing, and rectangular-shaped outer faces 46.

Each face of the pair of flat, parallel, opposing, and rectangular-shaped outer faces 46 of the rectangular-shaped flag 28 includes a flag face red "DIVERS BELOW" indica 48 that extends therealong between the flag vertically-oriented inner edge 42 of the rectangular-shaped flag 28 to the flag vertically-oriented outer edge 44 of the rectangular-shaped flag 28, parallel to, and slightly below, the flag horizontally-oriented upper edge 30 of the rectangular-shaped flag 28.

Each face of the pair of flat, parallel, opposing, and rectangular-shaped outer faces 46 of the rectangular-shaped flag 28 further includes a flag face red and rectangular-shaped field 49 that extends from the flag vertically-oriented inner edge 42 of the rectangular-shaped flag 28 to the flag vertically-oriented outer edge 44 of the rectangular-shaped flag 28, and from the flag horizontally-oriented lower edge 36 of the rectangular-shaped flag 28 to slightly below the flag face red "DIVERS BELOW" indica 48 of the rectangular-shaped flag 28.

The flag face red and rectangular-shaped field 49 of each face of the pair of flat, parallel, opposing, and rectangular-shaped outer faces 46 of the rectangular-shaped flag 28 includes a flag face field diagonally-oriented white stripe 50 that extends diagonally downward thereacross.

The rectangular-shaped flag 28 extends perpendicularly horizontally outwardly from, and is integral with, the mast tube upper portion 18 of the inflatable, hollow, elongated, slender, vertically-oriented, and generally cylindrically-shaped mast tube 16, with the flag vertically-oriented inner edge 42 of the rectangular-shaped flag 28 being disposed longitudinally along the mast tube generally cylindrically-shaped outer surface 26 of the inflatable, hollow, elongated, slender, vertically-oriented, and generally cylindrically-shaped mast tube 16, and with the flag horizontally-oriented upper edge 30 of the rectangular-shaped flag 28 being collinear with the mast tube upper portion flat, closed, and horizontally-oriented upper end 20 of the inflatable, hollow, elongated, slender, vertically-oriented, and generally cylindrically-shaped mast tube 16.

The combination inflatable dive flag and float 10 further includes an automatic pressure relief and manual deflation valve 52 that provides an automatic means of preventing over inflation and potential rupture of the inflatable, hollow, elongated, slender, vertically-oriented, and generally cylindrically-shaped mast tube 16 while also providing a manual means of deflating the inflatable, hollow, elongated, slender, vertically-oriented, and generally cylindrically-shaped mast tube 16.

The automatic pressure relief and manual deflation valve 52 is in fluid communication with the inflatable, hollow, elongated, slender, vertically-oriented, and generally cylindrically-shaped mast tube 16 and is disposed on the mast tube upper portion 18 of the inflatable, hollow, elongated, slender, vertically-oriented, and generally cylindrically-shaped mast tube 16, in proximity of the mast tube upper portion flat, closed, and horizontally-oriented upper end 20 of the inflatable, hollow, elongated, slender, vertically-oriented, and generally cylindrically-shaped mast tube 16.

The combination inflatable dive flag and float 10 further includes a rectangular-shaped weight pocket 54 that is disposed on, and covers, one side of the mast tube lower portion flat, closed, and generally rectangular-shaped lower end 24 of the mast tube lower portion 22 of the inflatable, hollow, elongated, slender, vertically-oriented, and generally cylindrically-shaped mast tube 16, and has a pocket open top 56 with a pocket top flap 58 that is selectively opened and closed by pocket top flap hook and loop fasteners 60, and a pocket closed bottom 62.

The rectangular-shaped weight pocket 54 further has a pocket drain throughbore 64 that extends therethrough in proximity of the pocket closed bottom 62 of the rectangular-shaped weight pocket 54 and provides a drain for any water trapped in the rectangular-shaped weight pocket 54.

The combination inflatable dive flag and float 10 further includes at least one rectangular-shaped weight 66 that is replaceably insertable in the rectangular-shaped weight pocket 54 and provides ballast for maintaining the inflatable, hollow, elongated, slender, vertically-oriented, and generally cylindrically-shaped mast tube 16 upright in the waterway 12. The at least one rectangular-shaped weight 66 is preferably a standard 5–6 lb. lead diver's weight.

The combination inflatable dive flag and float 10 further includes an L-shaped inflation valve 68 that provides a means of inflating the inflatable, hollow, elongated, slender, vertically-oriented, and generally cylindrically-shaped mast tube 16 either by a releasible connection to an air gun attached to any scuba regulator low pressure hose for maximum shaft rigidity or orally when used as a maximum visibility safety tube, and whose orifice is selectively opened and closed by an inflation valve cap 69.

The L-shaped inflation valve 68 is in fluid communication with the inflatable, hollow, elongated, slender, vertically-oriented, and generally cylindrically-shaped mast tube 16 and is disposed on the mast tube lower portion 22 of the inflatable, hollow, elongated, slender, vertically-oriented, and generally cylindrically-shaped mast tube 16, in proximity of the flat, closed, and generally rectangular-shaped lower end 24 of the mast tube lower portion 22 of the inflatable, hollow, elongated, slender, vertically-oriented, and generally cylindrically-shaped mast tube 16.

The combination inflatable dive flag and float 10 further includes an anchor line grommet eye 70 for releasibly attaching an anchor line or a tow line, and is disposed through the mast tube lower portion flat, closed, and generally rectangular-shaped lower end 24 of the mast tube lower portion 22 of the inflatable, hollow, elongated, slender, vertically-oriented, and generally cylindrically-shaped mast tube 16, between the L-shaped inflation valve 68 and the pocket top flap 58 of the rectangular-shaped weight pocket 54.

The combination inflatable dive flag and float 10 further includes an elongated, slender, and rectangular-shaped strap 72 that has a strap proximal end 73 fixedly attached to, and extending downwardly from, a mast tube lower portion lower end lowermost horizontally-oriented edge 74 of the mast tube lower portion flat, closed, and generally rectangular-shaped lower end 24 of the mast tube lower portion 22 of the inflatable, hollow, elongated, slender, vertically-oriented, and generally cylindrically-shaped mast tube 16, a strap free distal end 76, a pair of parallel, and opposing faces 78, and strap hook and loop fasteners 80 that has a strap hook and loop fasteners hook portion 82 affixed on one face of the pair of parallel, and opposing faces 78 of the elongated, slender, and rectangular-shaped strap 72 in proximity of the strap proximal end 73 of the elongated, slender, and rectangular-shaped strap 72 and a strap hook and loop fasteners mating loop portion 84 affixed on another face of the pair of parallel, and opposing faces 78 of the elongated, slender, and rectangular-shaped strap 72 in proximity to the strap distal end 76 of the elongated, slender, and rectangular-shaped strap 72 and releasibly engaging the strap hook and loop fasteners hook portion 82 of the strap hook and loop fasteners 80 on the elongated, slender, and rectangular-shaped strap 72.

The configuration of the automatic pressure relief and manual deflation valve 52 can best be seen in FIG. 4, which is an enlarged diagrammatic perspective view of the automatic pressure relief and manual deflation valve generally enclosed in the dotted circle identified by arrow 3 in FIG. 2, and as such will be discussed with reference thereto.

The automatic pressure relief and manual deflation valve 52 includes a valve ring-shaped flange 86 that is in fluid communication with the inflatable, hollow, elongated, slender, vertically-oriented, and generally cylindrically-shaped mast tube 16 and is fixedly attached to the mast tube upper portion 18 of the inflatable, hollow, elongated, slender, vertically-oriented, and generally cylindrically-shaped mast tube 16, in proximity of the mast tube upper portion flat, closed, and horizontally-oriented upper end 20 of the inflatable, hollow, elongated slender, vertically-oriented, and generally cylindrically-shaped mast tube 16.

The automatic pressure relief and manual deflation valve 52 further includes a valve hollow, externally-threaded, and cylindrically-shaped neck 88 that extends perpendicularly outwardly from, and is in fluid communication with, the valve ring-shaped flange 86 of the automatic pressure relief and manual deflation valve 52, and contains a valve neck seat 89.

The automatic pressure relief and manual deflation valve 52 further includes a valve circular-shaped diaphragm 90 disposed in, and selectively opening and closing, the valve hollow, externally-threaded, and cylindrically-shaped neck 88 of the automatic pressure relief and manual deflation valve 52 by selective contact against the valve neck seat 89 in the valve hollow, externally-threaded, and cylindrically-shaped neck 88 of the automatic pressure relief and manual deflation valve 52.

The automatic pressure relief and manual deflation valve 52 further includes a valve slender rod 92 that extends perpendicularly outwardly from the valve circular-shaped diaphragm 90 of the automatic pressure relief and manual deflation valve 52, and terminates in a valve rod free end 93.

The automatic pressure relief and manual deflation valve 52 further includes a valve spring 94 that has a compression factor and encircles the valve slender rod 90 of the automatic pressure relief and manual deflation valve 52 with one end thereof abutting against the valve circular-shaped diaphragm 90 of the automatic pressure relief and manual deflation valve 52.

The automatic pressure relief and manual deflation valve 52 further includes a valve internally threaded cap 96 that threadably engages the valve hollow, externally-threaded, and cylindrically-shaped neck 88 of the automatic pressure relief and manual deflation valve 52 and has a valve cap inner surface 97 and a valve cap ring-shaped flange 98 that sealingly abuts against the valve ring-shaped flange 86 of the automatic pressure relief and manual deflation valve 52.

The valve internally threaded cap 96 of the automatic pressure relief and manual deflation valve 52 further has a valve cap plurality of circumferential throughbores 100 disposed therearound and a valve cap centrally-disposed throughbore 102 that freely receives the valve slender rod 92 of the automatic pressure relief and manual deflation valve 52 with the valve rod free end 93 of the valve slender rod 92 of the automatic pressure relief and manual deflation valve 52 extending therethrough and with another end of the valve spring 94 of the automatic pressure relief and manual deflation valve 52 abutting against the valve cap inner surface 97 of the valve internally threaded cap 96 of the automatic pressure relief and manual deflation valve 52 so as to bias the valve circular-shaped diaphragm 90 of the automatic pressure relief and manual deflation valve 52 against the valve neck seat 89 of the valve hollow, externally-threaded, and cylindrically-shaped neck 88 of the automatic pressure relief and manual deflation valve 52 and maintain air with a pressure in the inflatable, hollow, elongated, slender, vertically-oriented, and generally cylindrically-shaped mast tube 16.

If, however, the inflatable, hollow, elongated, slender, vertically-oriented, and generally cylindrically-shaped mast tube 16 becomes overinflated with the air whose pressure is greater than the compression factor of the valve spring 94 of the automatic pressure relief and manual deflation valve 52, the pressure of the air causes the valve circular-shaped diaphragm 90 of the automatic pressure relief and manual deflation valve 52 to displace away from the valve neck seat 89 in the valve hollow, externally-threaded, and cylindrically-shaped neck 88 of the automatic pressure relief and manual deflation valve 52, against the biasing of the valve spring 94 of the automatic pressure relief and manual deflation valve 52, and allow the air to escape through the valve cap plurality of circumferential throughbores 100 in the valve internally threaded cap 96 of the automatic pressure relief and manual deflation valve 52 until the pressure of the air is less than the compression factor of the valve spring 94 of the automatic pressure relief and manual deflation valve 52 causing the valve spring 94 of the automatic pressure relief and manual deflation valve 52 to expand and reseat the valve circular-shaped diaphragm 90 of the automatic pressure relief and manual deflation valve 52 against the valve neck seat 89 of the valve hollow, externally-threaded, and cylindrically-shaped neck 88 of the automatic pressure relief and manual deflation valve 52.

The automatic pressure relief and manual deflation valve 52 further includes a valve pull string 104 that extends from the valve rod free end 93 of the valve slender rod 92 of the automatic pressure relief and manual deflation valve 52 and terminates in an appropriately-shaped hand gripper 106 that fits comfortably in a hand of the diver 14 and provides a means, when pulled, for causing the valve slender rod 92 of the automatic pressure relief and manual deflation valve 52 to extend further through the valve cap centrally-disposed throughbore 102 in the valve internally threaded cap 96 of the automatic pressure relief and manual deflation valve 52 and displace the valve circular-shaped diaphragm 90 of the automatic pressure relief and manual deflation valve 52 away from the valve neck seat 89 of the valve hollow, externally-threaded, and cylindrically-shaped neck 88 of the automatic pressure relief and manual deflation valve 52, against the biasing of the valve spring 94 of the automatic pressure relief and manual deflation valve 52, and allow the air to escape through the valve cap plurality of circumferential throughbores 100 in the valve internally threaded cap 96 of the automatic pressure relief and manual deflation valve 52 and deflate the inflatable, hollow, elongated, slender, vertically-oriented, and generally cylindrically-shaped mast tube 16 when desired.

The manner of preparing the combination inflatable dive flag and float 10 for storage can best be seen in FIGS. 2 and 4, which are again an enlarged perspective view of the present invention in an inflated position, and a diagrammatic perspective view of the present invention in a deflated position and rolled for transport or storage, respectively, and as such will be discussed with reference thereto.

STEP 1: Remove the at least one rectangular-shaped weight 66 from the rectangular-shaped weight pocket 54.

STEP 2: Pull the appropriately-shaped hand gripper 106 of the automatic pressure relief and manual deflation valve 52 causing the automatic pressure relief and manual deflation valve 52 to open and deflate the inflatable, hollow, elongated, slender, vertically-oriented, and generally cylindrically-shaped mast tube 16.

STEP 3: Fold the rectangular-shaped flag 28 around the inflatable, hollow, elongated, slender, vertically-oriented, and generally cylindrically-shaped mast tube 16.

STEP 4: Roll the inflatable, hollow, elongated, slender, vertically-oriented, and generally cylindrically-shaped mast tube 16 downwardly towards, but on the opposite side of, the L-shaped inflation valve 68.

STEP 5: Place the elongated, slender, and rectangular-shaped strap 72 under the L-shaped inflation valve 68 and wrap it around the now rolled up inflatable, hollow, elongated, slender, vertically-oriented, and generally cylindrically-shaped mast tube 16 and engage the strap hook and loop fasteners hook portion 82 of the strap hook and loop fasteners 80 on the elongated, slender, and rectangular-shaped strap 72 with the strap hook and loop fasteners mating loop portion 84 of the strap hook and loop fasteners 80 on the elongated, slender, and rectangular-shaped strap 72.

It will be understood that each of the elements described above, or two or more together, may also find a useful application in other types of constructions differing from the types described above.

While the invention has been illustrated and described as embodied in a combination inflatable dive flag and float, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A combination inflatable dive flag and float that visually marks a position in a waterway where a diver is diving, comprising:

a) an inflatable, hollow, elongated, slender, vertically-oriented, and generally cylindrically-shaped mast tube being upright extendable from the position in the waterway where the diver is diving and having an upper portion terminating in a flat, closed, and horizontally-oriented upper end extending out of the waterway, a lower portion terminating in a flat, closed, and generally rectangular-shaped lower end extending into the waterway, a generally cylindrically-shaped outer surface, and a deflated position, so that said combination inflatable dive flag and float can be deflated and rolled for transit and storage;

b) a rectangular-shaped flag having a horizontally-oriented upper edge with a proximal end and a distal end, a horizontally-oriented lower edge disposed below, and parallel to, said horizontally-oriented upper edge of said rectangular-shaped flag and having a proximal end and a distal end, a vertically-oriented inner edge extending perpendicularly downwardly from said proximal end of said horizontally-oriented upper edge of said rectangular-shaped flag to said proximal end of said horizontally-oriented lower edge of said rectangular-shaped flag, a vertically-oriented outer edge extending perpendicularly downwardly from said distal end of said horizontally-oriented upper edge of said rectangular-shaped flag to said distal end of said horizontally-oriented lower edge of said rectangular-shaped flag, and a pair of flat, parallel, opposing, and rectangular-shaped outer faces; said rectangular-shaped flag extending perpendicularly horizontally outwardly from, and being integral with, said upper portion of said inflatable, hollow, elongated, slender, vertically-oriented, and generally cylindrically-shaped mast tube, with said vertically-oriented inner edge of said rectangular-shaped flag being disposed longitudinally along said generally cylindrically-shaped outer surface of said inflatable, hollow, elongated, slender, vertically-oriented, and generally cylindrically-shaped mast tube, and with said horizontally-oriented upper edge of said rectangular-shaped flag being collinear with said flat, closed, and horizontally-oriented upper end of said inflatable, hollow, elongated, slender, vertically-oriented, and generally cylindrically-shaped mast tube, so that the position in the waterway where the diver is diving is visually marked and c) an automatic pressure relief and manual deflation valve being in fluid communication with said inflatable, hollow, elongated, slender, vertically-oriented, and generally cylindrically-shaped mast tube and providing an automatic means of preventing over inflation and potential rupture of said inflatable, hollow, elongated, slender, vertically-oriented, and generally cylindrically-shaped mast tube while also providing a manual means of deflating said inflatable, hollow, elongated, slender, vertically-oriented, and generally cylindrically-shaped mast tube when desired; said automatic pressure relief and manual deflation valve being disposed on said upper portion of said inflatable, hollow, elongated, slender, vertically-oriented, and generally cylindrically-shaped mast tube, in proximity of said flat, closed, and horizontally-oriented upper end of said inflatable, hollow, elongated, slender, vertically-oriented, and generally cylindrically-shaped mast tube.

2. The combination as defined in claim 1, wherein said inflatable, hollow, elongated, slender, vertically-oriented, and generally cylindrically-shaped mast tube is 6" in diameter, 4' high, and is of one of nylon and lift bag material.

3. The combination as defined in claim 1, wherein said rectangular-shaped flag is one of a standard size dive flag and an Alpha flags.

4. The combination as defined in claim 1, wherein each face of said pair of flat, parallel, opposing, and rectangular-shaped outer faces of said rectangular-shaped flag includes a red "DIVERS BELOW" indica that extends therealong between said vertically-oriented inner edge of said rectangular-shaped flag and said vertically-oriented outer edge of said rectangular-shaped flag, and is parallel to, and slightly below, said horizontally-oriented upper edge of said rectangular-shaped flag.

5. The combination as defined in claim 4, wherein each face of said pair of flat, parallel, opposing, and rectangular-shaped outer faces of said rectangular-shaped flag further includes a red and rectangular-shaped field that extends from said vertically-oriented inner edge of said rectangular-shaped flag to said vertically-oriented outer edge of said rectangular-shaped flag, and from said horizontally-oriented lower edge of said rectangular-shaped flag to slightly below said red "DIVERS BELOW" indica on said rectangular-shaped flag.

6. The combination as defined in claim 5, wherein said red and rectangular-shaped field of each face of said pair of flat, parallel, opposing, and rectangular-shaped outer faces of said rectangular-shaped flag includes a diagonally-oriented white stripe that extends diagonally downwardly thereacross.

7. The combination as defined in claim 1, wherein said automatic pressure relief and manual deflation valve includes a ring-shaped flange that is in fluid communication with said inflatable, hollow, elongated, slender, vertically-oriented, and generally cylindrically-shaped mast tube and is fixedly attached to said upper portion of said inflatable, hollow, elongated, slender, vertically-oriented, and generally cylindrically-shaped mast tube, in proximity of said flat, closed, and horizontally-oriented upper end of said inflatable, hollow, elongated, slender, vertically-oriented, and generally cylindrically-shaped mast tube.

8. The combination as defined in claim 7, wherein said automatic pressure relief and manual deflation valve further includes a hollow, externally-threaded, and cylindrically-shaped neck that extends perpendicularly outwardly from, and is in fluid communication with, said ring-shaped flange of said automatic pressure relief and manual deflation valve, and contains a valve seat.

9. The combination as defined in claim 8, wherein said automatic pressure relief and manual deflation valve further includes a circular-shaped diaphragm disposed in, and selectively opening and closing, said hollow, externally-threaded, and cylindrically-shaped neck of said automatic pressure relief and manual deflation valve by selective contact against said valve seat in said hollow, externally-threaded, and cylindrically-shaped neck of said automatic pressure relief and manual deflation valve.

10. The combination as defined in claim 9, wherein said automatic pressure relief and manual deflation valve further includes a slender rod that extends perpendicularly outwardly from said circular-shaped diaphragm of said automatic pressure relief and manual deflation valve, and terminates in a free end.

11. The combination as defined in claim 10, wherein said automatic pressure relief and manual deflation valve further includes a spring that has a compression factor and encircles said slender rod of said automatic pressure relief and manual deflation valve with one end of said spring of said automatic pressure relief and manual deflation valve abutting against said circular-shaped diaphragm of said automatic pressure relief and manual deflation valve.

12. The combination as defined in claim 11, wherein said automatic pressure relief and manual deflation valve further includes an internally threaded cap that threadably engages said hollow, externally-threaded, and cylindrically-shaped neck of said automatic pressure relief and manual deflation valve and has an inner surface and a cap ring-shaped flange that sealingly abuts against said ring-shaped flange of said automatic pressure relief and manual deflation valve.

13. The combination as defined in claim 12, wherein said internally threaded cap of said automatic pressure relief and manual deflation valve further has a plurality of circumferential throughbores disposed therearound and a centrally-disposed throughbore that freely receives said slender rod of said automatic pressure relief and manual deflation valve with said free end of said slender rod of said automatic pressure relief and manual deflation valve extending therethrough and with another end of said spring of said automatic pressure relief and manual deflation valve abutting against said inner surface of said internally threaded cap of said automatic pressure relief and manual deflation valve so as to bias said circular-shaped diaphragm of said automatic pressure relief and manual deflation valve against said valve seat in said hollow, externally-threaded, and cylindrically-shaped neck of said automatic pressure relief and manual deflation valve and maintain air with a pressure in said inflatable, hollow, elongated, slender, vertically-oriented, and generally cylindrically-shaped mast tube until said inflatable, hollow, elongated, slender, vertically-oriented, and generally cylindrically-shaped mast tube becomes over-inflated wherein the pressure of the air is greater than said compression factor of said spring of said automatic pressure relief and manual deflation valve and the pressure of the air causes said circular-shaped diaphragm of said automatic pressure relief and manual deflation valve to displace away from said valve seat in said hollow, externally-threaded, and cylindrically-shaped neck of said automatic pressure relief and manual deflation valve, against biasing of said spring of said automatic pressure relief and manual deflation valve, and allow the air to escape through said plurality of circumferential throughbores in said internally threaded cap of said automatic pressure relief and manual deflation valve until the pressure of the air is less than said compression factor of said spring of said automatic pressure relief and manual deflation valve causing said spring of said automatic pressure relief and manual deflation valve to expand and reseat said circular-shaped diaphragm of said automatic pressure relief and manual deflation valve against said valve seat in said hollow, externally-threaded, and cylindrically-shaped neck of said automatic pressure relief and manual deflation valve.

14. The combination as defined in claim 13, wherein said automatic pressure relief and manual deflation valve further includes a pull string that extends from said free end of said slender rod of said automatic pressure relief and manual deflation valve and terminates in an appropriately-shaped hand gripper that fits comfortably in a hand of the diver and provides a means, when pulled, for causing said slender rod of said automatic pressure relief and manual deflation valve to extend further out of said centrally-disposed throughbore in said internally threaded cap of said automatic pressure relief and manual deflation valve and displace said circular-shaped diaphragm of said automatic pressure relief and manual deflation valve away from said valve seat in said hollow, externally-threaded, and cylindrically-shaped neck of said automatic pressure relief and manual deflation valve, against the biasing of said spring of said automatic pressure relief and manual deflation valve, and allow the air to escape through said plurality of circumferential throughbores in said internally threaded cap of said automatic pressure relief and manual deflation valve and deflate said inflatable, hollow, elongated, slender, vertically-oriented, and generally cylindrically-shaped mast tube when desired.

15. The combination as defined in claim 1, further comprising a rectangular-shaped weight pocket disposed on, and covering, one side of said flat, closed, and generally rectangular-shaped lower end of said lower portion of said inflatable, hollow, elongated, slender, vertically-oriented, and generally cylindrically-shaped mast tube and having an open top with a flap being selectively opened and closed by hook and loop fasteners, and a closed bottom.

16. The combination as defined in claim 15, wherein said rectangular-shaped weight pocket further has a drain hole in proximity of said closed bottom of said rectangular-shaped weight pocket which provides a drain for any water trapped in said rectangular-shaped weight pocket.

17. The combination as defined in claim 15; further comprising at least one rectangular-shaped weight replaceably insertable in said rectangular-shaped weight pocket and providing ballast for maintaining said inflatable, hollow, elongated, slender, vertically-oriented, and generally cylindrically-shaped mast tube upright in the waterway.

18. The combination as defined in claim 17, wherein said at least one rectangular-shaped weight is a standard 5–6 lb. lead diver's weight.

19. The combination as defined in claim 15; further comprising a L-shaped inflation valve in fluid communication with, and providing a means of inflating, said inflatable, hollow, elongated, slender, vertically-oriented, and generally cylindrically-shaped mast tube; said L-shaped inflation valve being disposed on said lower portion of said inflatable, hollow, elongated, slender, vertically-oriented, and generally cylindrically-shaped mast tube, in proximity of said flat, closed, and generally rectangular-shaped lower end of said lower portion of said inflatable, hollow, elongated, slender, vertically-oriented, and generally cylindrically-shaped mast tube.

20. The combination as defined in claim 19, wherein said L-shaped inflation valve is one of releasibly connectable to an air gun that is attachable to a scuba regulator low pressure hose and orally accessible, and has an orifice that is selectively opened and closed by a cap.

21. The combination as defined in claim 19; further comprising a grommet eye for releasibly attaching said combination inflatable dive flag and float to one of an anchor line and a tow line and being disposed through said flat, closed, and generally rectangular-shaped lower end of said lower portion of said inflatable, hollow, elongated, slender, vertically-oriented, and generally cylindrically-shaped mast tube, between said L-shaped inflation valve and said flap of said rectangular-shaped weight pocket.

22. The combination as defined in claim 1; further comprising an elongated, slender, and rectangular-shaped strap having a proximal end fixedly attached to, and extending downwardly from, a lowermost horizontally-oriented edge of said flat, closed, and generally rectangular-shaped lower end of said lower portion of said inflatable, hollow, elongated, slender, vertically-oriented, and generally cylindrically-shaped mast tube, a free distal end, a pair of parallel, and opposing faces, and hook and loop fasteners with a hook portion affixed on one face of said pair of parallel, and opposing faces of said elongated, slender, and rectangular-shaped strap in proximity of said proximal end of said elongated, slender, and rectangular-shaped strap and a mating loop portion affixed on another face of said pair of parallel, and opposing faces of said elongated, slender, and rectangular-shaped strap in proximity to said free distal end of said elongated, slender, and rectangular-shaped strap and releasibly engagable with said hook portion of said strap hook and loop fasteners on said elongated, slender, and rectangular-shaped strap.

* * * * *